US006598878B1

(12) United States Patent
Burrowes

(10) Patent No.: US 6,598,878 B1
(45) Date of Patent: Jul. 29, 2003

(54) METHOD AND BOARD GAME FOR TEACHING VOCABULARY

(76) Inventor: Sherwin D. Burrowes, 150 Canterbury Ct., Hightstown, NJ (US) 08520-5511

( * ) Notice: Subject to any disclaimer, the term of this patent is extended or adjusted under 35 U.S.C. 154(b) by 0 days.

(21) Appl. No.: 10/042,667

(22) Filed: Jan. 9, 2002

(51) Int. Cl.[7] ..... A63F 3/00
(52) U.S. Cl. ..... 273/243; 273/272; 273/429
(58) Field of Search ..... 273/272, 292, 273/242, 243, 429, 430, 431, 432, 248, 249, 256

(56) References Cited

U.S. PATENT DOCUMENTS

| | | | | |
|---|---|---|---|---|
| 3,143,348 A | | 8/1964 | Carsen et al. | 273/152.1 |
| 3,602,513 A | | 8/1971 | Breen | 273/135 B |
| 3,939,578 A | | 2/1976 | Coffey | 35/9 R |
| 4,055,347 A | * | 10/1977 | Kreischer | 273/243 |
| 4,090,717 A | | 5/1978 | Rossetti | 273/249 |
| 4,640,513 A | * | 2/1987 | Montijo | 273/249 |
| 4,889,344 A | * | 12/1989 | Zimba | 273/243 |
| 4,907,807 A | * | 3/1990 | Lee et al. | 273/240 |
| 4,998,736 A | * | 3/1991 | Elrod | 273/249 |
| 5,288,075 A | * | 2/1994 | Kelley | 273/243 |
| 5,308,079 A | * | 5/1994 | Dreznick et al. | |
| 5,645,280 A | * | 7/1997 | Zelmer | 273/256 |
| 5,660,389 A | * | 8/1997 | Freda, III | 273/249 |
| 5,906,371 A | * | 5/1999 | Peterson | 273/249 |

* cited by examiner

*Primary Examiner*—William M. Pierce
(74) *Attorney, Agent, or Firm*—Kenneth Watov; Watov & Kipnes, P.C.

(57) ABSTRACT

The present invention is generally directed to a game for teaching vocabulary playable as a competition between two or more players having comparable or disproportionate vocabulary skills, the game comprising a game board with a play surface including a start point space, an end point space and a plurality of movement spaces arranged linearly to form a sequentially predetermined play path, select ones of the plurality of movement spaces including a first indicia for indicating a play command to a player, a set of game cards, each of the game cards including at least one vocabulary clue and a corresponding answer, a select one of the vocabulary clue of a select game card corresponding to a difficulty level which matches a vocabulary skill level assigned to a player, a set of PASS cards, each of the PASS cards being distributable to at least one opposing player when a player passes a turn, and redeemable by a passing player possessing a PASS card, a plurality of play pieces configured for marking movement on the play path between the start point space and the end point space, each of the plurality of play pieces being assignable to a player, and means for randomly generating a number to determine the number of movement spaces to move a current player's play piece along the play path. The invention is further directed to a computerized version of the game.

22 Claims, 8 Drawing Sheets

METHOD AND BOARD GAME FOR TEACHING VOCABULARY

FIELD OF THE INVENTION

This invention relates generally to board games, and more particularly to educational board games and methods for teaching vocabulary.

BACKGROUND OF THE INVENTION

Numerous games have been developed and played through the ages to provide suspense and excitement. Games generally attempt to simulate the more intense human experiences including physical skill, intellectual contest and excitement involved in random occurrences. For both adults and children, games have a strong appeal because they deal with specific issues in a way that is sufficiently simplified to be manageable within the imposed limits of space and time. Gaming techniques are frequently incorporated into educational programs to make them more stimulating and fun which, in turn, promotes learning through heightened motivation and positive reinforcement. A properly designed educational game is capable of capturing and holding the attention of the player, while at the same time convey the requisite information to the player in a manner in which it will be easily and effectively retained.

One form of educational game often played includes those based on words. Word games have been played since the advent of the spoken language, and usually involve manipulating the basic units of language for amusement and entertainment while at the same time fostering learning. These types of games are used to hone the player's vocabulary and language skills. These games also condition the player's intellect and reasoning by challenging his imagination and general knowledge. Some word games are simple enough for preschool children to play while others are extremely complex. Most word games can be played by a single individual but are usually more fun at large gatherings of people as in classrooms or parties. Word games are typically designed for a specific skill level and tailored for players possessing the same or similar skill levels. Such word games, however, do not provide the same stimulation and fun between players of disproportionate skill levels such as between a child and an adult, for example.

Accordingly, there is a need for a game for teaching vocabulary which accommodates and stimulates players of varying vocabulary skills and facilitates game play on an equal footing, while effectively challenging the skills of each individual player. There is a further need for a game which is both simple to implement and to play while providing positive stimulation and fun to promote enhanced learning. Thus, it is highly desirable to provide a game that not only conveys the necessary information, but does so in a manner that players find interesting and entertaining, and motivates the players to play on a regular basis which desirably encourages retainment of the conveyed information.

SUMMARY OF THE INVENTION

The present invention is generally directed to an educational game and method for teaching vocabulary that conveys relevant information to a player in an interesting and entertaining manner, thereby encouraging repeated play on a regular basis all of which promotes learning and better retainment. The game of the present invention is designed to provide a participating player with a degree of enjoyment while at the same time, testing and honing the player's vocabulary skills. Moreover, the game is adapted to accommodate players of varying vocabulary skills and facilitate level game play therebetween, while effectively challenging the skills of each individual player. The game can be played in any one of several languages including English. Alternatively, the game can be played in more than one language for teaching or practicing vocabulary of a different language. The game can be played by one person alone, or by groups of persons such as competing teams. The game is played by initially assigning a play piece and vocabulary skill level for each player, and placing the play piece on a start point space of a unique game board.

The game board includes a plurality of movement spaces defining a play path which includes a start point space and an end point space for concluding the play path over the surface thereof In one embodiment, select ones of the movement spaces include play commands to enhance and direct the dynamics of the game play. The game further includes at least one deck of game cards. Each game card comprises a word/phrase visible on one side thereof, and a corresponding definition visible on the other side of the card which varies in levels of difficulty between each card. Alternatively, each game card can include a word/phrase and corresponding definition corresponding to a specific level of difficulty, in different embodiments of the invention. Depending on the mode of play, the word/phrase or the definition can be used as a vocabulary clue. In this regard, the player is shown the word/phrase and then the player must provide the corresponding definition, or the player is shown the definition and the player must provide the corresponding word/phrase. The goal of each player is to correctly answer each clue and progressively move the assigned play piece from the start point space to the end point space of the play path before the other players to achieve a win.

In one aspect of the present invention, the game provides for teaching vocabulary competitively playable between two or more players having comparable or varying vocabulary skill levels, and comprises:

- a game board with a play surface including a start point space, an end point space and a plurality of movement spaces arranged linearly to form a sequentially predetermined play path where select ones of the plurality of movement spaces include a first indicia for indicating a play command to a player;
- a set of game cards, each of the game cards including at least one vocabulary clue and a corresponding answer, each select one of the vocabulary clue of a select game card of said set of game cards, respectively, corresponding to a difficulty level matching a vocabulary skill level assigned to a player;
- a set of PASS cards, each of the PASS cards being distributable to at least one opposing player when a player passes a turn, and redeemable by a passing player possessing a PASS card;
- a plurality of play pieces configured for marking movement on the play path between the start point space and the end point space, each of the plurality of play pieces being assignable to a player; and
- means for randomly generating a number to determine the number of movement spaces of the play piece of the current player to cross along the play path.

In another aspect of the present invention, a method is provided for playing a game for teaching vocabulary competitively playable between two or more players having comparable or varying vocabulary skill levels, wherein the method comprises:

furnishing a game board with a play surface including a start point space, an end point space and a plurality of movement spaces arranged linearly to form a sequentially predetermined play path where select ones of the plurality of movement spaces include a first indicia for indicating a play command to a player;

assigning one of a plurality of play pieces to each player for placement on the start point space on the game board;

assigning a vocabulary skill level to each player;

furnishing a set of game cards, each of the game cards including at least one vocabulary clue and a corresponding answer, each select one of the vocabulary clue of a select game card of said set of game cards, respectively, corresponding to a difficulty level matching a vocabulary skill level assigned to a player;

selecting a player for a turn as a current player, drawing by chance a game card from the set of game cards, the drawing being made by the current player;

indicating to the current player the vocabulary clue on the drawn game card corresponding to a difficulty level which matches the vocabulary skill level assigned to the current player;

determining randomly a number of movement spaces the player advances or retreats the assigned play piece on the play path;

receiving the answer to the vocabulary clue from the current player;

advancing the assigned play piece of the current player on the play path by a number of movement spaces randomly determined, if the answer is correct; and retreating the assigned play piece on the play path by the number of movement spaces randomly determined, if the answer is incorrect.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

Figure 1:
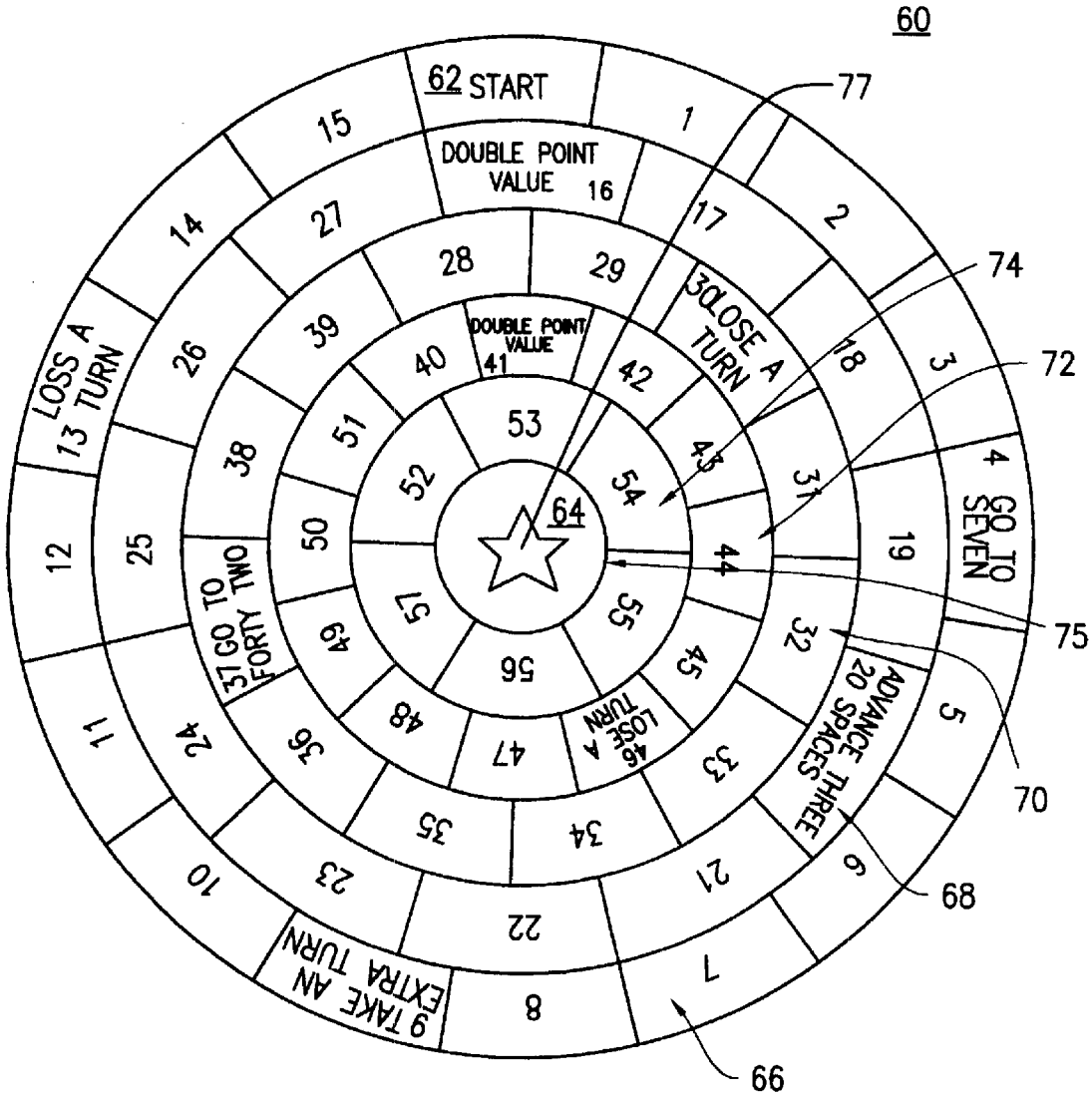
FIG. 1 is a top plan view of a game board in accordance with one embodiment the present invention.

The present invention is generally directed to a game for teaching vocabulary through competitive play between two or more players with comparable or disproportionate vocabulary skills. The game of the present invention is designed to convey relevant information to a player in an interesting and entertaining manner, thereby encouraging repeat play on a regular basis, all of which promotes learning and retainment. In particular, the game of the present invention is designed to provide a participating player with a degree of enjoyment while at the same time, testing and honing the player's vocabulary skills. The game can be played in one of several languages including English. Alternatively, the game can be played in more than one language for teaching or practicing vocabulary of a different language. The present invention is further directed to a method for playing a board game to teach vocabulary.

The game includes the use of a game board which comprises a plurality of movement spaces defining a play path with a start point space and an end point space each at the opposed ends of the path. In certain embodiments, select ones of the movement spaces include play commands to enhance and direct the dynamics of the game play, whereas in other embodiments such spaces may not be included. The game further includes at least one game deck of game cards. Each game card comprises a word/phrase visible on one side thereof, and a corresponding definition visible on the other side of the card which varies in levels of difficulty between each card. Alternatively, each game card can include a word/phrase and corresponding definition corresponding to a specific level of difficulty. Depending on the mode of play, the word/phrase or the definition can be used as a vocabulary clue. In this regard, the player can be shown the word/phrase and then the player must provide the corresponding definition, or the player can be shown the definition and the player must provide the corresponding word/phrase.

Each player of the game is directed to provide correct definitions corresponding to words or phrases read to the player or to provide a correct word or synonym corresponding to the definition of that word or phrase when the game is played in one language. Alternatively, if the game is played in more than one language, each is directed to provide a word, phrase, or definition in one language, which corresponds to that word, phrase, or definition given in the other language. The player is afforded an opportunity to answer the game card while being read or displayed the vocabulary clue corresponding to the player's assigned level of difficulty. In accordance with the rules of the game, upon providing a correct word, phrase or definition, the player or team is permitted to advance the assigned play piece around the board along the play path based on the number shown from a random number generator, such as from the throw of pair of dice or a die, for example. The player who reaches the end point space first is declared the winner of the game.

These and other features of the present invention will be more clearly understood from a consideration of FIG. 1 of the Drawings which shows a game board identified by the reference numeral 60, which can be utilized in accordance with the teaching rules and instructions for playing the game and increasing vocabulary skills. The game board 60 includes in one embodiment a series of concentric circular paths 66, 68, 70, 72 and 74, five in number in this embodiment, a start point space 62 and an end point space 64 enclosed by a circular perimeter 75 about a central star 77, with a plurality of movement spaces 1 through 57 arranged sequentially therebetween to define a play path. The outermost path 66 is divided into sixteen spaces (denoted 62 and 1 though 15). The next, innermost path 68 is also divided into twelve spaces (denoted 16 through 27), while the next innermost path 70 similarly has twelve spaces (denoted 28 through 39). The next innermost path 72 is also divided into twelve spaces (denoted 40 through 51). Finally, the concentric path 74 is divided into four spaces (denoted 52 through 57). Note that in other embodiments the paths providing the play path can be other than concentric circular paths, such as concentric square or rectangular paths. Also, the path can be a continuous spiral from the outermost starting position to the innermost end space.

The play path can simply be traced from the start point space 62 to the end point space 64 by moving a play piece (not shown) along the plurality of movement spaces 1 through 57 in a sequential manner. In a simple embodiment, the play path can be a simple and linear path extending around the playing surface of the game board 60 in a creative fashion, although the preferred embodiment includes a spiral-like configuration that circularly extends around a central portion of the playing surface.

As will be seen, the movement spaces denoted as 4, 9, 13, 16, 20, 30, 37, 41, and 46, each carry indicia representing instructions or command such as, for example, "go to seven", "take an extra turn", "lose a turn", "double point value", "advance three spaces", "lose a turn", "go to forty-two", "double point value", and "lose a turn," respectively. As will be appreciated by one skilled in the art, the above examples are provided mainly for purposes of illustration in the present embodiment of the invention as shown in the drawings, and such "commands" or "instructions", as well as the particular game board design including the number of movement spaces, placement of the movement spaces, the shape and configuration of the play path, and the like can be modified without departing from the scope of the teachings of the invention.

The game board 60 further includes a variety of game accessories which facilitate game play. The variety of game accessories includes a plurality of play pieces (not shown) for monitoring and marking the positions on the movement spaces 62, 64 and 1–57 of the game board 60. Each play piece is assigned to one of the plurality of players. In addition to the game board 60 and the play pieces, the game of the invention includes at least one deck comprising a plurality of game cards 76 (as best shown in FIGS. 2A, 2B, 3A, 3B, 4A, and 4B), and a random number generator (not shown) such as pair of dice or a die, for example. The game can optionally include a timer (not shown) and a plurality of cardholders (not shown) to hold the game cards 76.

Each player is permitted to choose a play piece or marker unique to the player by color, shape, indicia, or otherwise. At the start of the game all the play pieces are placed on the start point space 62 of the game board 60. The number of players or teams is preferably two or more, more preferably between two and ten, most preferably from three to five players or teams. As noted above, it is emphasized that the game of the present invention is adapted to simultaneously accommodate and stimulate players of varying vocabulary skill levels while sustaining and enhancing the dynamics of the game play for each of those participating.

Figure 2A:
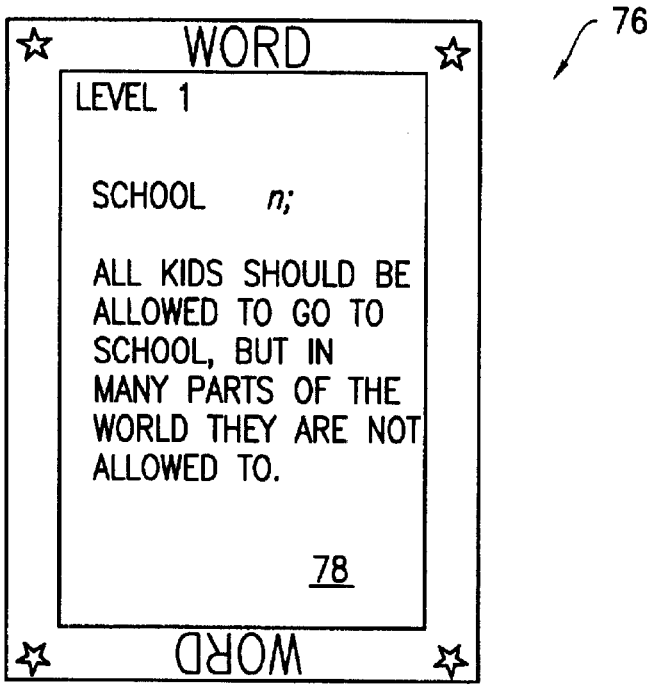
FIGS. 2A and 2B show elevational views of the front and back, respectively, of an example of a game card corresponding to a particular vocabulary difficulty level for one embodiment of the present invention.
Figure 2B:
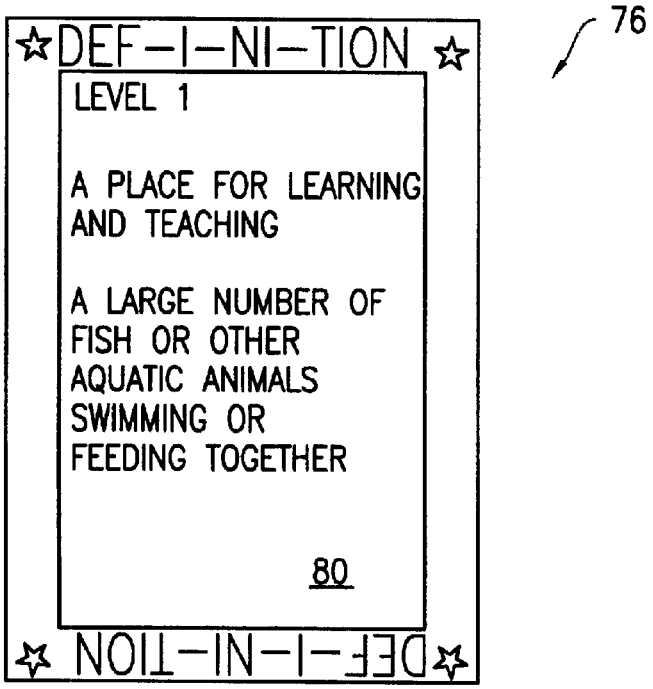
Figure 3A:
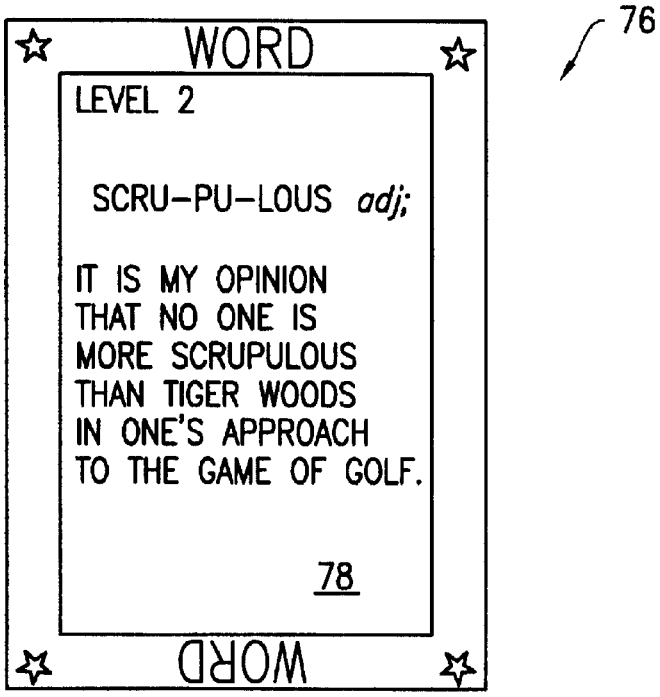
FIGS. 3A and 3B show elevational views of the front and back, respectively, of an example of a game card corresponding to a second particular vocabulary difficulty level for one embodiment of the present invention.
Figure 3B:
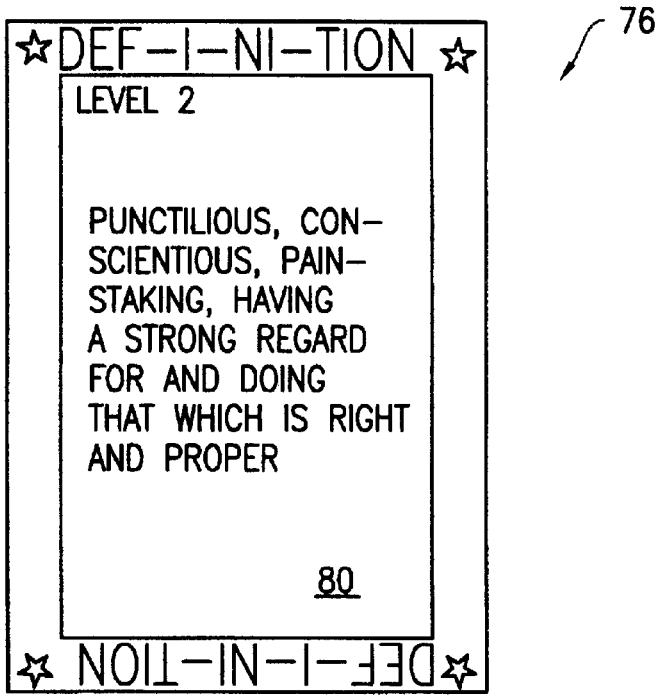
Figure 4A:
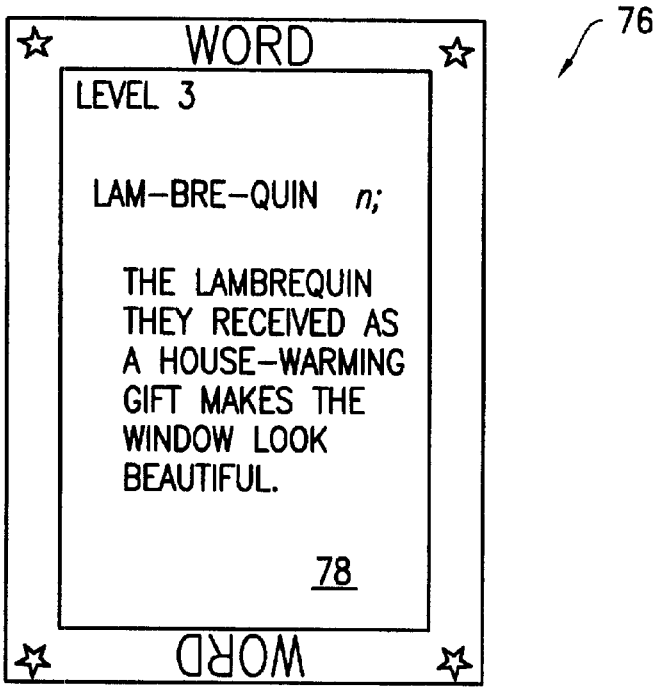
FIGS. 4A and 4B show elevational views the front and back, respectively, of an example of a game card corresponding to a third particular vocabulary difficulty level for one embodiment of the present invention.
Figure 4B:
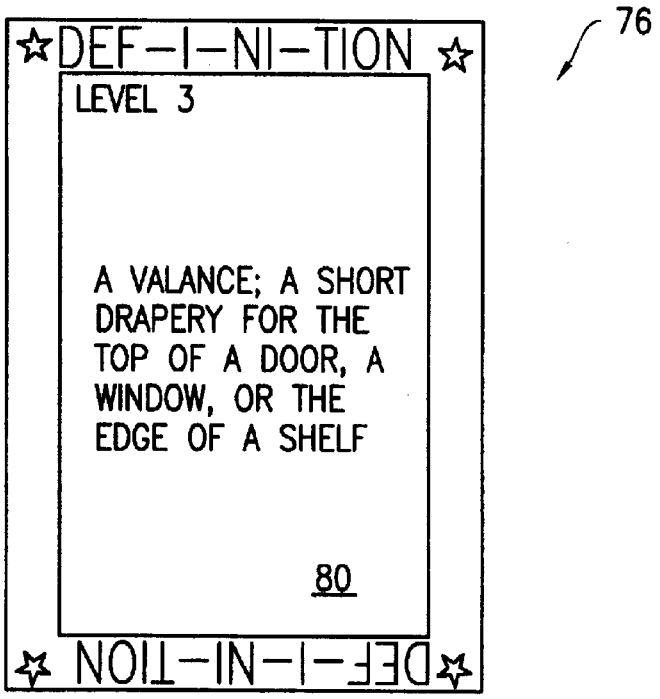

Referring to FIGS. 2A and 2B, the game card 76 includes a word or phrase on one side 78 thereof and a corresponding definition for the word or phrase on the opposed side 80 thereof, representing one particular level of vocabulary difficulty ("Level 1', in this example). With reference to FIGS. 3A and 3B, and 4A and 4B, the game cards 76 are shown for illustrating examples of more advanced vocabulary difficulty levels (Levels 2 and 3, respectively). Although not specifically illustrated in the drawings, note that each game card 76 can be adapted within the scope of the invention to contain three words, or three phrases, each of a different level of difficulty for ease of card handling and reducing the number of card decks in the game. Each of the words, phrases and definitions are numbered according to the degree of difficulty of that word, phrase, or definition. If it is desired to utilize a game card 76 for teaching vocabulary, the front side 78 (which includes the word to be defined) of the game card 76 can also include a synonym and/or the functional use of the word to be utilized in helping the player to furnish a proper definition.

The random number generator (not shown) of the game can be a pair of dice or a single die. The random number generator is used generally for determining movement along the play path on the game board 60, and optionally, to determine which player goes first in the game. Each die is generally six sided and can be conventionally marked. Alternatively, the die can include two of the sides having "one" dot, with two sides having "two" dots, while the remaining two sides have "three" dots.

An optional timer (not shown) can be used for games where it is desirable to time the actions of the current player. In this mode of play, if the player fails to provide an adequate answer within the allotted time, the player would be penalized. The timer can comprise a device with a push button to be depressed in starting the timer, along with any appropriate visible and/or audible indicator to be activated at a predetermined time after the push button has been depressed, or a timing instrument consisting of a glass vessel having two compartments from the uppermost of which a quantity of a flowable substance such as sand, water, or mercury runs into the lowermost one. The cardholder (not shown) can be nothing more than a rectangular container with one end open and a top.

The plurality of play pieces, are each used to monitor and track the individual positions of each player or team on the game board 60. It is noted that, when used in conjunction with game board 60, the play piece can be a 'man" or a similar figure which can be moved from one area to another area on the game board 60, and of the type to distinguish one from another.

It should be appreciated and emphasized once more that the game can be played concurrently at different levels of difficulty. As so far described, three levels of difficulty are envisioned as shown in FIGS. 2A and 2B, 3A and 3B, and 4A and 4B, respectively. The levels are "Level 1" (a junior level), "Level 2" (an intermediate level) and "Level 3" (a senior level). On each game card 76 there are words and/or phrases and definitions, each preceded by the number which corresponds to the level of difficulty of that word, phrase, or definition, set forth above. A correct answer to the "Level 1" word, phrase, or definition, will permit the player to move the play piece the number of movement space as predetermined by the random thrown of the dice or die. The same holds true for proper answers to the "Level 2" word, phrase, or definition, and to the "Level 3" word, phrase, or definition, i.e., one, two or three spaces are moved forward or advanced upon giving a correct answer to the word, phrase, or definition in question, depending upon the number of die spots showing with each throw. If an incorrect answer is given upon a roll of the die, the play piece is moved backwards by the corresponding number of spaces indicated on the die.

Figure 5:
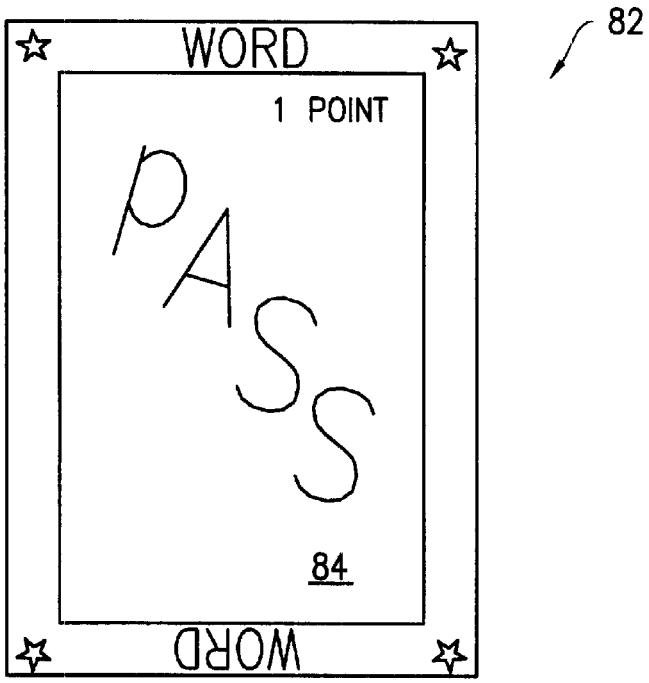
FIG. 5 is an elevational view of an example of a one-point PASS card in one embodiment of the present invention.

Referring to FIG. 5, the game in one embodiment of the present invention can further include a set of PASS cards 82 which may be accumulated by the players during the course of the game as will be described hereinafter in connection with the play methods of the game. The PASS card 82 includes indicia for identifying itself as a PASS card on side 84 and can include a point mark as will be further discussed.

Figure 6:
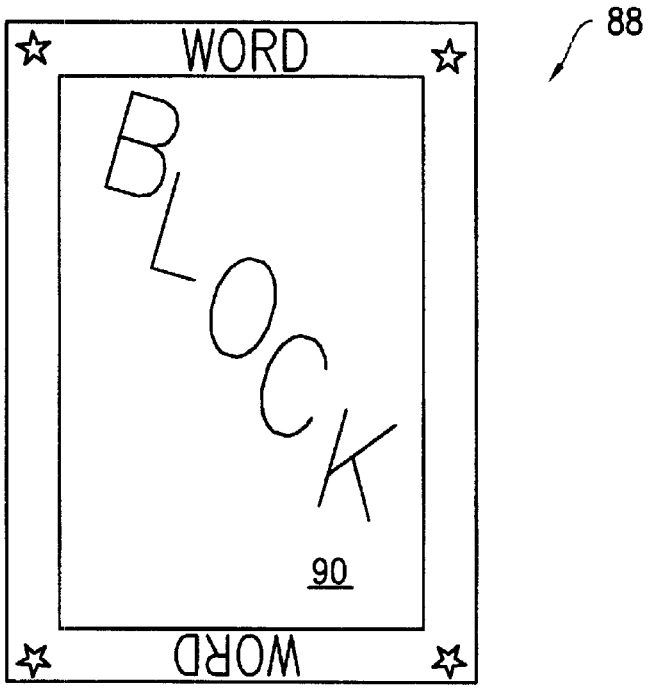
FIG. 6 is an elevational view of an example of a BLOCK card in one embodiment of the present invention.

Referring to FIG. 6, the game in one embodiment of the present invention can further include a set of BLOCK cards 88 which can be acquired and retained by the players during play as will be described hereinafter in connection with the play methods of the game. The BLOCK card 88 includes indicia for identifying itself as a BLOCK card on side 84.

It is noted that minor variations in such items as the number of players, the number of difficulty levels, time allotted to answer the clue, specifics as to attaining and using the PASS and BLOCK cards 88, 84, respectively, the total number of movement spaces on the game board, the configuration of the play path on the game board 60, the arrangement of the word/phrases and the definitions, and the like, can be made without departing from the scope of the invention.

Figure 7:
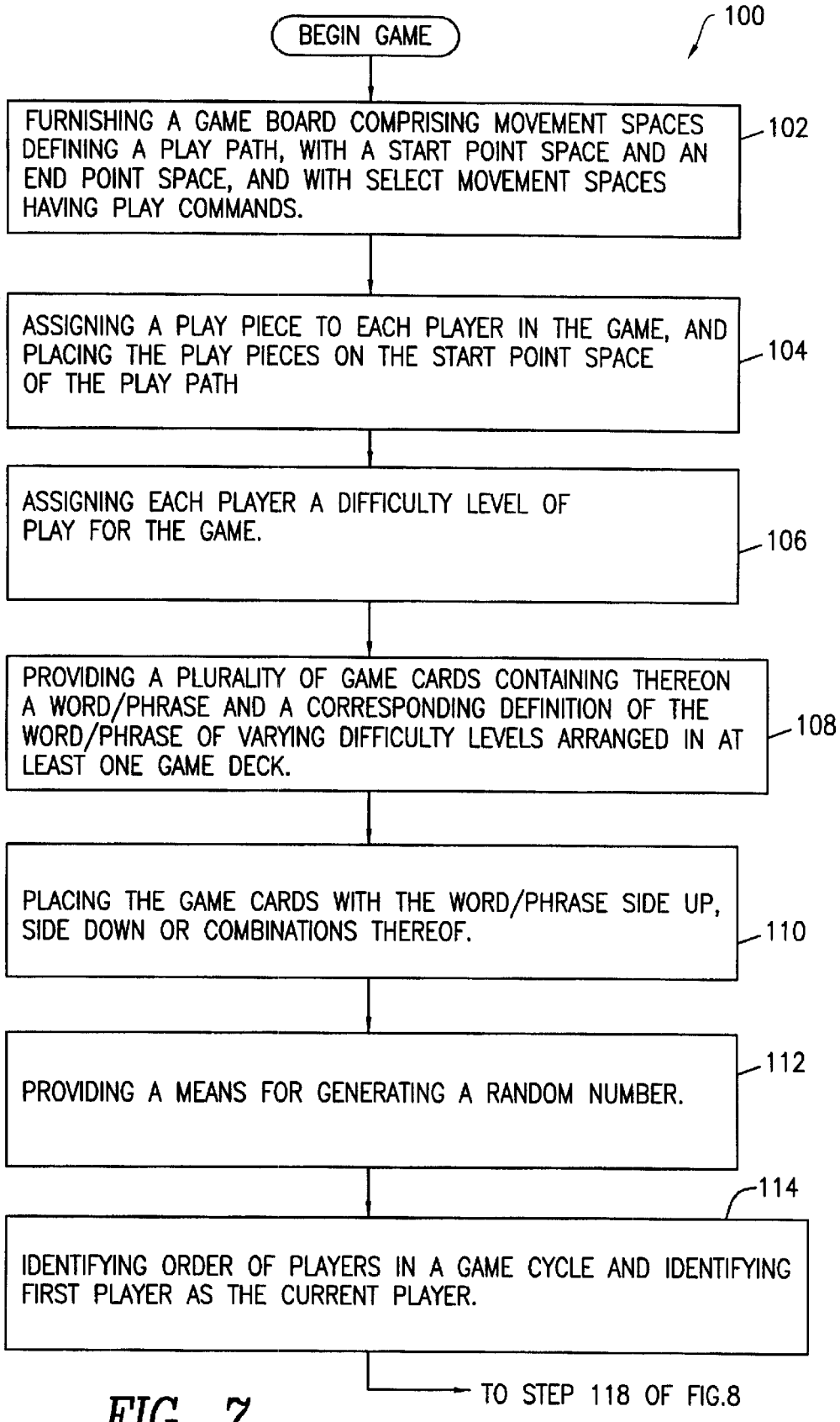
FIGS. 7 and 8, in combination, illustrate a flowchart showing the steps of playing the game for one embodiment of the present invention.
Figure 8:
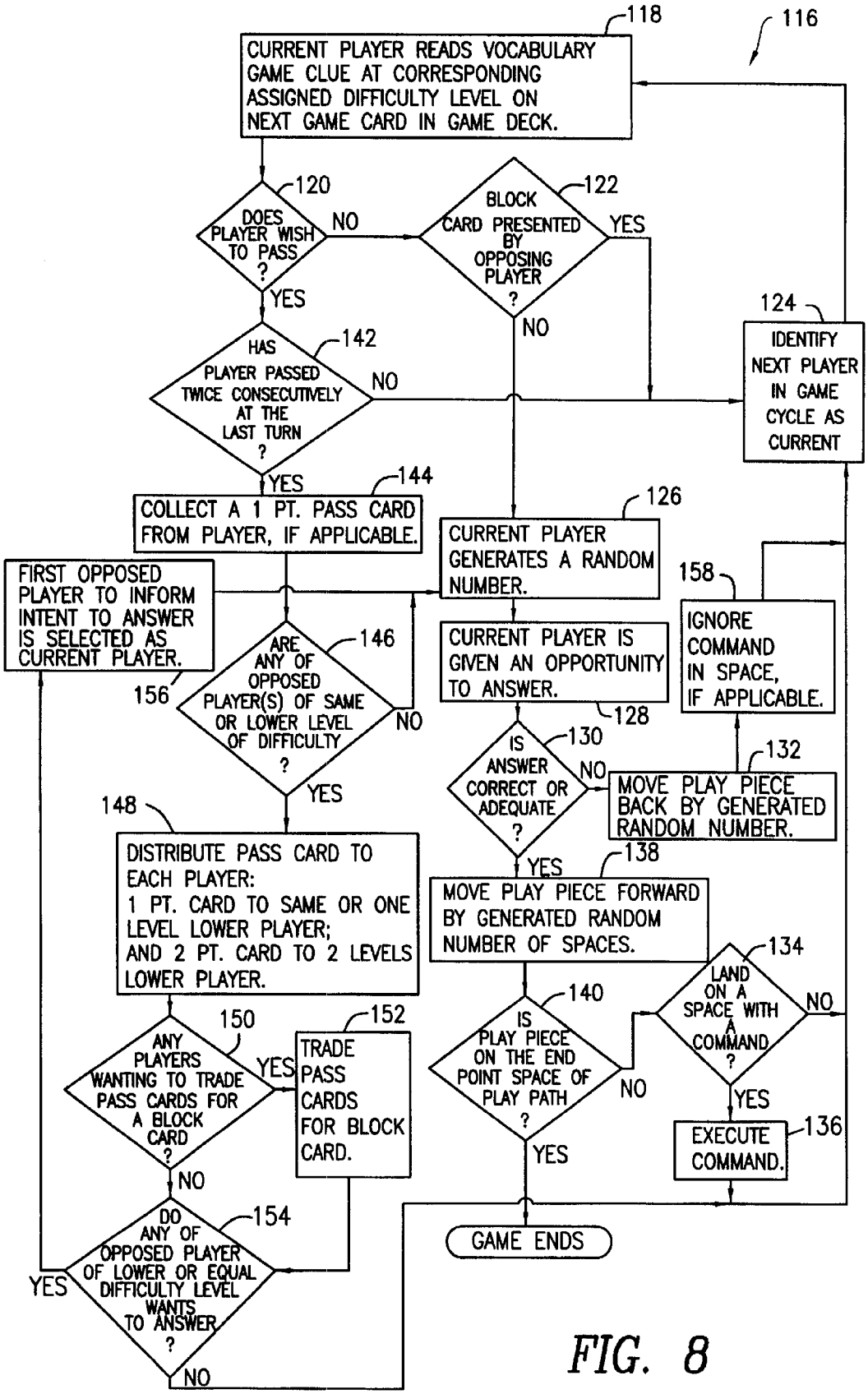

With reference to FIGS. 7 and 8, the preferred method of playing the game of the present invention will be explained in detail. Referring specifically to FIG. 7, a flow chart 100 is shown to illustrate the initial preparation, method, and setup of the game play. In step 102 of the game play, the game is initiated by furnishing the game board 60 of FIG. 1. Each player or team selects a play piece and places it on the start point space 62 as indicated in step 104. Movement of the play piece during play in a single turn can be made either in the forward or backward direction (depending on the outcome of the random number generator and whether or not a correct answer was given by the player), along the play path as defined by the sequentially arranged plurality of movement spaces 1–57.

A difficulty level is assigned to each player according to the player's skill level in step 106 of the game play. The difficulty level can be assigned according to the player's age or knowledge of vocabulary. For example, the game can be designed to accommodate "Level 1" players comprising individuals of ages 6 to 12, "Level 2" players comprising individuals of ages 13 to 18, and "Level 3" players comprising individuals of ages 18 and up.

In steps 108 and 110 of the game play, the game deck is furnished. The game deck comprises a plurality of game cards 76 containing words/phrases and corresponding definitions of varying difficulty levels with the words/phrases side, the definition side, or combination thereof facing up depending upon whether the player is to give a definition for a word question being asked, or whether he is to be doing the asking of another player. All the game cards 76 are shuffled randomly and placed in a cardholder or on the game board 60. Generally, all the players, at the start of the game, can also agree to referring to a common reference book such as an authoritative source for validating words. For example, the players can choose a standard dictionary or a thesaurus. Alternatively, when the game is played in two languages, all the game cards 76 can be placed in the cardholder, with the words and/or phrases in one language facing up or being mixed. In such an arrangement the questions are asked in one language, and the answers are made in the other language. The game cards 76 can be arranged to have the words and phrases in both languages facing both up or down, depending upon how the game is to be played.

In steps 112 and 114, the selection of the first player is determined by lots through the use of the random number generator included in the game, or any other method agreed upon by the players. The random number generator can be any one of a variety of known chance means, such as dice or die, a spinning dial, drawing numbers from a vessel, an automated lottery device, or simply flipping coins.

Preferably, a die is used to determine which player goes first in the game. Each player or team rolls a single die one at a time. The player rolling the highest number starts the game. If two or more players roll the same highest number, those players, and only those players, can keep rolling the die an equal number of times until one player wins the starting turn. When it has been determine which player is to be the first player, the game play proceeds to step 118 of FIG. 8. Once the starting player's turn has been completed, the progression of players proceeds in a clockwise direction around the game board 60 from the starting player.

Referring specifically to FIG. 8, flowchart 116 is shown which begins with step 118 in proceeding from FIG. 7 for a play method of the game. The game cards 76 can be arranged with the word/phrase side up, the definition side up, or combination of both as noted above. The game cards 76 can be arranged in separate decks grouped according to the skill level and selected from a particular deck according to the skill level of the answering player. Alternatively, each game card 76 can include a word, phrase or definition from each skill level in the game, thus permitting the arrangement of the game cards in a single deck.

From step 114 of FIG. 7, the game proceeds to step 118 of FIG. 8 where a game card 76 is drawn from the top of the game deck. The player to the left of the current one, reads or displays the vocabulary clue on top of the drawn game card 76 corresponding to the assigned skill level of the current player. The current player is then given the opportunity to pass or to answer, in step 120 of the game play.

Optionally, the player to the left of the current player can also initiate the timer to maintain the pace of the game. A preset time period can be selected in which the player can answer correctly or pass. The preselected time can vary according to the skill and assigned difficulty level of the current player. However, preferably, the time period allowed can range from about 30 seconds to 1 minute. At the end of the preselected time, the player to the left of the current player checks the correctness and timeliness of the answer in step 130 of the game play.

If the current player decides to answer, the player is required to roll the dice or die to specify the number of movement spaces at stake prior to answering the clue. Prior to rolling the dice or die, the opposing players have an opportunity to block the current player's turn in step 122 of the game play. If one of the opposing players possesses a BLOCK card 88 and wishes to block the current player, the blocking player must present the BLOCK card 88 prior to the throw of the dice or die. A player can obtain a BLOCK card 88 in exchange for a prerequisite number of PASS cards 82 in the player's possession. PASS cards 82 can be accumulated by the player during the course of the game as will be described in detail hereinafter. If a block is successful, the current player loses a turn and the next player is selected for the next turn to answer a new game card 76 as indicated in step 124 of the game play. It is again noted that a block can be made only if it is executed before the player throws the dice or die in step 126 of the game play. Once the outcome of the dice or die is known, the current player is required to answer the vocabulary clue as indicated in step 128 of the game play.

If the answer provided is wrong or inadequately made, the current player moves the play piece backward on the game board 60 by the exact number of movement spaces indicated by the dice or die which ends the turn. If the play piece is on the start point space 62, the player remains on the same space and retreats no further, thus ending the turn for the current player. If the player lands on a movement space bearing a visual designation or indicia corresponding to a command, the player is required to ignore the command as indicated in step 158, and the game play then proceeds to step 124 where the next player is selected to answer a new game card 76. If the movement space is blank, the game play then proceeds to step 124 where the next player is selected to answer a new game card 76.

If the answer provided is correct, the current player moves the play piece forward on the game board 60 by the exact number of movement spaces indicated by the dice or die (see step 138). If the player lands on a movement space bearing a visual designation or indicia corresponding to a command, the player is required to obey and implement the command as indicated in steps 134 and 136 of the game play. The command can be implemented by the player in the current turn or in the next turn of play depending on the specific nature of command as will be explained in detail hereinafter. If, during the course of the move, the play piece lands on the end point space 64 in step 140, the player is declared the winner of the game and the game ends. It is noted that the player is still declared the winner, even if the outcomes of the dice or die is greater than the number of movement spaces piece lands on a blank movement space, the game play then proceeds to step 124 where the next player is selected to answer a new game card 76.

As mentioned above, the player has an option to pass a turn after reviewing the vocabulary clue on the game card 76 as indicated in step 120 of the game play. The player is permitted to consecutively pass twice in two turns without incurring a penalty as indicated in step 142 of the game play. However, the player is required to answer the vocabulary clue on the next turn after the two successive passes without being penalized. If the player passes three or more times consecutively, the opposing players who are of equal or lower skill level, are entitled to receive and retain PASS cards 82 for each pass occurrence as indicated in step 146 of the game play. Any opposing player of the same level or one level lower to the current player is entitled to a one-point PASS card, and any opposing player two levels lower to the current player is entitled to two one-point PASS cards 82. In this manner, players can accumulate multiple PASS cards 82 during the course of the game. During the course of the game, each player is required upon request to show the number of PASS cards 82 accumulated to the other players. A player possessing one or more PASS cards 82 can pass more than two consecutive times without suffering a penalty only upon redeeming a one-point PASS card for each consecutive pass as indicated in step 144 of the game play. It is noted that in the event where none of the opposing players are of the same or lower skill level than the current player, the current player having made two consecutive passes immediately before, is required to roll the dice or die, and attempt to answer the vocabulary clue, as indicated in step 146 of the game play.

During the course of the game, players are permitted to exchange a prerequisite number of PASS cards 82 (e.g., six) in their possession for one BLOCK card 88 as indicated in steps 150 and 152 of the game play. Once acquiring a BLOCK card 88, the player can use the BLOCK card 88 to block an opposing player for one turn only. To place a block on a player, the blocking player is required to say "Block" and tender the BLOCK card 88 before the current player gets an opportunity to throw the dice or die. Once the BLOCK card 88 is used, it is returned to the BLOCK card deck (not shown).

It is further noted that when a player passes, opposing players of equal or lower levels can choose the option of answering the passed game card 76 as indicated in step 154 of the game play. The first opposing player to signal his intent to the other players, is given the opportunity to answer the vocabulary clue as indicated in step 156 of the game play. As the game of the present invention encompasses competition between players of different experience and skill, a player playing on the senior level of difficulty would not be permitted to answer questions that were passed on by players at the junior or intermediate level. However, the game permits a player at the junior level to answer questions passed on by other players at the intermediate, or senior level of difficulty. In this manner, competition can be fostered between a child and a parent with the novice player participating at a lower level of difficulty, and the advance player participating at a higher level of difficulty. Because the object of the game is to reach the end point space 64 of the game board 60 first, effective competition is encouraged between players of different experience and education level, by their answering clues of different difficulty at the same time, and by permitting the less educated player to answer those questions that were passed by the more educated, skillful, experienced player. Once the opposing player is selected to answer a passed clue, the timer is optionally started and the game play proceeds to step 126 where the selected opposing player throws the dice or die prior to answering the clue. Once the answer has been given, the current game card 76 is removed from play. In the event that none of the opposing player wants to answer the passed clue, the game play proceeds from step 154 to step 124 where the next player is selected to answer a new game card 76.

In the alternative rules of play, all the rules are the same as in the embodiment described above, with the exception that the "Level 1" players are exempt from the use of PASS or BLOCK cards 82, 88, respectively.

As will be readily apparent to those skilled in the art, disputes might arise as to the correctness of any given definition, word or phrase corresponding to a word, phrase or definition clue. In such circumstances, a neutral observer can act as an arbitrator in resolving the dispute, such as by referring to an available dictionary, a thesaurus, and the like. If no arbitrator is available, and no reference work can be utilized in resolving the difficulty, then the player's turn can be nullified, and another drawing of the game card 76 and roll of the die will be permitted in its place.

With respect to the commands shown on the game board 60 at movement spaces 4, 9, 13, 16, 20, 30, 37, 41, and 46, it will be understood that these commands carry the following meanings:

a) Command 4, "Go to Seven", instructs the player to immediately move the play piece to movement space 7 upon landing thereon;

b) Command 9, "Take An Extra Turn", instructs the player to immediately draw a new game card 76 for answering where an new opportunity to answer or pass is given;

c) Command 13, "Lose a Turn", instructs the player to forgo a turn in the next round of play;

d) Command 16, "Double Point Value", instructs the player that the outcome of the dice or die is doubled at a turn in the next round of play;

e) Command 20, "Advance Three Spaces", instructs the player to immediately move the play piece ahead three spaces upon landing thereon; and f) Command 37, "Go to Forty-two", instructs the player to immediately move the play piece to movement space 42 upon landing thereon.

Although the present invention has so far been described in the context of competing play as between two players or teams, it will be readily apparent that the game can also be played by one player playing alone. Such a player can continue to amass or subtract points, as he moves around the game board 60. As will also be apparent, in this manner only one set of game cards 76 is needed, and only one set of game cards 76 is needed if competing players alternatively decide to play from the same set of game cards 76, and not from separate sets of game cards 76 held in their respective cardholders. Whether a "timer" is used or not depends upon the preference of the players, and upon their various skill levels.

As will be appreciated, one of the main advantages of the present invention lies in its ability to permit play between individuals of varying skill levels and experience. To learn vocabulary, it is one thing to have a child being questioned by an adult to see whether the child knows various definitional meanings. No competition exists between them, however. And, as such, the interest of the child in the game has been found to quickly wane. On the other hand, with the invention as described, competition can still exist between the child and the adult, with the child obviously playing on a lower level of skill than the adult and, therefore, being asked easier questions than those asked of the adult. Two things follow in this respect 1) the child is also hearing the words asked of the adult and learning of the definition for them, and in this way learns more difficult vocabulary; and 2) a continuing interest in the game as both players try to move their play pieces around the game board 60 in an attempt to be the winner. That the child can be being asked easier question than the adult is of little relevancy, as the competition between the two is such as to continue the interest of the child in arriving at the correct answer for the word, phrase, or definition being asked.

Because the vocabulary clues are read out loud and then answered afterward, the game serves not only to test the player's vocabulary knowledge, but as an effective study tool. The game aids retention of words, phrases and definitions through repetition and competition. Players read the clues, answer the clues, and discuss the answer afterwards. Everyone learns during the process.

While there has been described what is considered to be a preferred embodiment of the present invention, it will be readily understood by those skilled in the art that modifications can be made without departing from the scope of the teachings herein. Thus, although one particular game board 60 has been described, it will be apparent that other configurations can be utilized equally as well. Similarly, whether commands are being utilized, the nature of the commands, and their number are all matters of design choice depending upon how complex one might wish to make the game board configuration. Equally apparent, as noted, the game of the present invention can be employed in teaching different languages, where questions asked in one language are to be answered in a separate language correctly, before any play piece can be move in a forward direction.

Even in such arrangement, it will be noted that although one participant can be playing the game in learning vocabulary going from one language to another, a further feature of the invention is that the opposing player can be playing the game in a totally different language, or without translating from one language to another. Thus, a child can be playing the game in translating from simple English, to simply Spanish, while the adult who is assisting the child in this instruction can be playing the game in trying to define more difficult words only in the English language, or in any other language, or in himself trying to translate from English to Spanish, French to English, German to French, or any other arrangement, all in accordance with the kinds or mix of game cards 76 employed. For all the foregoing reasons, the scope of the present invention can best be determined from a reading of the claims appended hereto.

Figure 9:
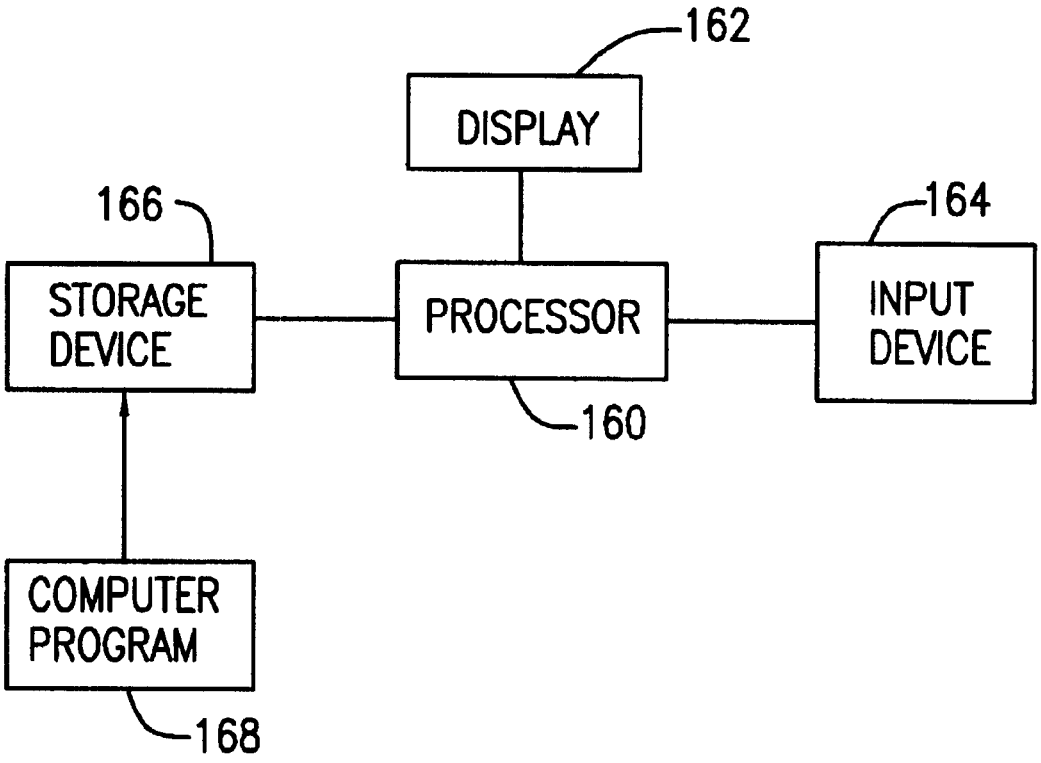
FIG. 9 is a block diagram of a computer system on which a computerized version of the game can be played for another embodiment of the invention.

The present invention is also applicable to computerized versions of the game where a computer system as shown in FIG. 9, comprising a processor 160 connected to a display 162, at least one input device 164, and a storage device 166 such as RAM, floppy disk, hard disk, or combination thereof for storing a computer program 168 is provided. The computer program 168 is configured to cause the processor 160 to carry out the steps embodied in the method of the game as described above, whereby the computer can be operated by at least one user for playing the game of the present invention, preferably one user for each player turn. For example, the game board 60 can be displayed on a computer screen of display 162 and random player movement can be provided by the computer system, as well as dealing of the game cards 76, and the PASS and BLOCK cards 82 and 88. In fact all or some of the cards may be eliminated with the computer configured to randomly provide the vocabulary clues at the appropriate skill level of the current player as well as the play commands, and track the possession of the PASS cards 82 and BLOCK cards 88 of all the players. The computerized version of the game method permits remotely located players to play against one another using a computer network. cards 76, and the PASS and BLOCK cards 82 and 88. In fact all or some of the cards may be eliminated with the computer configured to randomly provide the vocabulary clues at the appropriate skill level of the current player as well as the play commands, and track the possession of the PASS cards 82 and BLOCK cards 88 of all the players. The computerized version of the game method permits remotely located players to play against one another using a computer network.

Although various embodiments of the invention have been shown and described, they are not meant to be limiting. With respect to the above description, it is to be realized that the optimum dimensional relationships for the parts of the invention, include variations in size, materials, shape, form, function, and manner of operation, assembly and use, and all equivalent relationships to those illustrated in the drawings and described in the specification are intended to be encompassed by the present invention. Those of skill in the art may recognize various modifications to these embodiments, which modifications are meant to be covered by the spirit and scope of the appended claims.

What is claimed is:

1. A game for teaching vocabulary competitively playable between two or more players having comparable or varying vocabulary skill levels, said game comprising:

a game board with a play surface including a start point space, an end point space and a plurality of movement spaces arranged linearly to form a sequentially predetermined play path where select ones of the plurality of movement spaces include a first indicia for indicating a play command to a player;

at least one vocabulary skill level keyed deck of game cards, each of the game cards including on one side at least one vocabulary clue and a corresponding answer on an opposing side, each select one of the vocabulary clue or clues of a select game card of said deck of game cards, respectively, corresponding to a difficulty level matching a vocabulary skill level assigned to one or more players, respectively;

a set of PASS cards, each of the PASS cards being distributable to at least one opposing player when a player passes a turn, and optionally redeemable by a passing player possessing a PASS card;

a plurality of play pieces configured for marking movement on the play path between the start point space and the end point space, each of the plurality of play pieces being assignable to a player;

a set of BLOCK cards, each of said BLOCK cards being distributable to a player upon exchanging a prerequisite number of PASS cards; and means for randomly generating a number to determine the number of movement spaces of the play piece of the current player to cross along the play path.

2. The game of claim 1 further comprising a timing device for indicating a preselected time period for furnishing the answer to the vocabulary clue.

3. The game of claim 1 wherein the random number selecting means includes at least one die.

4. The game of claim 1 wherein the said vocabulary clue is selected from a first language and the corresponding answer is selected from a second language.

5. The game of claim 1 wherein the sequentially predetermined play path comprises a plurality of concentric circular paths.

6. A method for playing a game for teaching vocabulary competitively playable between two or more players having comparable or varying vocabulary skill levels, said method comprising the steps of:

furnishing a game board with a play surface including a start point space, an end point space and a plurality of movement spaces arranged linearly to form a sequentially predetermined play path where select ones of said plurality of movement spaces include a first indicia for indicating a play command to a player;

assigning one of a plurality of play pieces to each player for placement on the start point space on the game board;

assigning a vocabulary skill level to each player;

furnishing at least one vocabulary skill level keyed deck of game cards, each of said game cards including on one side at least one vocabulary clue and a corresponding answer on an opposing side, each select one of said vocabulary clue or clues of a select game card of said deck of game cards, respectively, corresponding to a difficulty level matching a vocabulary skill level assigned to one or more players, respectively;

selecting a player for a turn as a current player;

drawing by chance a game card from the deck of game cards, the drawing being made by the current player;

indicating to the current player the vocabulary clue on said drawn game card corresponding to a difficulty level which matches the vocabulary skill level assigned to the current player;

determining randomly a number of movement spaces the player advances or retreats the assigned play piece on the play path;

receiving the answer to the vocabulary clue from the current player;

advancing the assigned play piece of the current player on the play path by the number of movement spaces randomly determined, if the answer is correct;

retreating the assigned play piece on the play path by the number of movement spaces randomly determined, if the answer is incorrect; and issuing a PASS card to each player of equal or one skill level lower than the current player and two PASS cards to each player two skill levels lower than the current player, after the current player passes two consecutive turns.

7. The method of claim 6, further comprising the step of issuing a BLOCK card to one of the players yielding a preselected number of accumulated PASS cards.

8. The method of claim 7, wherein the preselected number of accumulated PASS cards is six.

9. The method of claim 7, further comprising the step of blocking the current player's turn by an opposing player surrendering a BLOCK card prior to the determination of the random number of movement steps.

10. The method of claim 6, further comprising the steps of:

allowing the current player to pass the turn; and affording one of the opposing players of a lower or equal skill level an opportunity to furnish the answer to the vocabulary clue of the drawn game card as a bonus turn.

11. The method of claim 6, further comprising the step of seizing a PASS card from the current player, if the current player passes twice consecutively.

12. The method of claim 6, further comprising the step of directing the current player to act in conformity with a play command assigned to one of the plurality of movement spaces, in connection to the landing of the current player's play piece on the corresponding movement space in a forward move.

13. The method of claim 6, wherein the determining step further comprises the step of rolling a die or pair of dice.

14. The method of claim 6, further comprising the step of timing the current player's turn to ensure its completion within an allotted time period.

15. The method of claim 6, wherein the vocabulary clue and the answer are expressed in different languages.

16. A game for teaching of vocabulary allowing for competition between two or more players having comparable or disproportionate vocabulary skills of varying degree, comprising:

a vocabulary skill level keyed deck of game cards, with each card of said deck having on one side a plurality of words or phrases to be defined, and with said plurality of words or phrases being of varying level of definitional difficulty on each of such card, one from another, and with each card also having on an opposing side a definition for each of said plurality of words or phrases on said card to be defined, and with each definition corresponding to the varying level of definitional difficulty of each plurality of words or phrases to be selected for definition, and with each card having on its one side at least one word or phrase to be defined of a difficulty level disproportionately greater than a second word or phrase on such card to be selected for definition, and also having on its opposing side a corresponding definition for such disproportionately more difficult word or phrase to be defined, wherein some of the plurality of words or phrases to be defined, and the definitions corresponding to said plurality of words or phrases, are in the same language, and optionally wherein others of the plurality of words or phrases to be defined, and the definitions corresponding to said other plurality of words or phrases, are in different languages;

a game board having a predetermined path, a plurality of play pieces to be moved around said board in the predetermined path, means for ascribing by chance specific movement space number to the words or phrases of said plurality of words or phrases being defined for movement of the play pieces on the predetermined path, wherein for one mode of play, players of comparable vocabulary skill selectively seek to define words or phrases of comparable level of definitional difficulty on each of said cards, and players of disproportionate vocabulary skills selectively seek to define words or phrases of disproportionate level of definitional difficulty on said same cards, and wherein for another mode of play, each player actuates said means to ascribe a specific movement space number to said word or phrase after such word or phrase has been properly defined;

a set of PASS cards, each of the PASS cards being distributable to at least one opposing player when a player passes a turn, and optionally redeemable by a passing player possessing a PASS card; and a set of BLOCK cards, each of said BLOCK cards being distributable to a player upon exchanging a prerequisite number of PASS cards.

17. A method for playing a computerized game for teaching vocabulary competitively playable between two or more players having comparable or varying vocabulary skill levels executable by a computer having a processor, a display device, a data input device, and a storage device, said method comprising the steps of:

electronically furnishing a game board with a play surface including a start point space, an end point space and a plurality of movement spaces arranged linearly to form a sequentially predetermined play path where select ones of said plurality of movement spaces include a first indicia for indicating a play command to a player on the computer display;

electronically assigning one of a plurality of play pieces to each player for placement on the start point space on the game board on the computer display;

electronically assigning a vocabulary skill level to each player;

electronically furnishing at least one vocabulary skill level keyed deck of game cards on the computer display, each of said game cards including on one side at least one vocabulary clue and a corresponding answer on an opposing side, each select one of said vocabulary clue or clues of a select game card of said deck of game cards, respectively, corresponding to a difficulty level matching a vocabulary skill level assigned to one or more players, respectively;

electronically selecting a player for a turn as a current player;

electronically drawing by chance a game card from the set of game cards, the drawing being made by the current player;

electronically indicating to the current player the vocabulary clue on said drawn game card corresponding to a difficulty level which matches the vocabulary skill level assigned to the current player;

electronically determining randomly a number of movement spaces the player advances or retreats the assigned play piece on the play path;

electronically receiving the answer to the vocabulary clue from the current player through the data input device;

electronically advancing on the computer display the assigned play piece of the current player on the play path by the number of movement spaces randomly determined, if the answer is correct;

electronically retreating on the computer display the assigned play piece on the play path by the number of movement spaces randomly determined, if the answer is incorrect; and electronically issuing a PASS card to each player of equal or one skill level lower than the current player and two PASS cards to each player two skill levels lower than the current player, after the current player passes two consecutive turns.

18. The game of claim 1, further including:

a plurality of vocabulary skill level keyed decks of game cards, wherein the game cards of each deck each include on one side a vocabulary clue corresponding to a difficulty level matching a vocabulary skill level assigned to at least one player, and on an opposing side a corresponding answer, whereby each respective deck is uniquely associated with a different vocabulary skill level.

19. The method of claim 6, further including the step of:

furnishing a plurality of vocabulary skill level keyed decks of game cards, wherein the game cards of each deck each include on one side a vocabulary clue corresponding to a difficulty level matching a vocabulary skill level assigned to at least one player, and on an opposing side a corresponding answer, whereby each respective deck is uniquely associated with a different vocabulary skill level.

20. A method for playing a game for teaching vocabulary competitively playable between two or more players having comparable or varying vocabulary skill levels, said method comprising the steps of:

furnishing a game board with a play surface including a start point space, an end point space and a plurality of movement spaces arranged linearly to form a sequentially predetermined play path where select ones of said plurality of movement spaces include a first indicia for indicating a play command to a player;

assigning one of a plurality of play pieces to each player for placement on the start point space on the game board;

assigning a vocabulary skill level to each player;

furnishing at least one vocabulary skill level keyed deck of game cards, each of said game cards including on one side at least one vocabulary clue and a corresponding answer on an opposing side, each select one of said vocabulary clue or clues of a select game card of said deck of game cards, respectively, corresponding to a difficulty level matching a vocabulary skill level assigned to one or more players, respectively;

selecting a player for a turn as a current player;

drawing by chance a game card from the deck of game cards, the drawing being made by the current player;

indicating to the current player the vocabulary clue on said drawn game card corresponding to a difficulty level which matches the vocabulary skill level assigned to the current player;

determining randomly a number of movement spaces the player advances or retreats the assigned play piece on the play path;

receiving the answer to the vocabulary clue from the current player;

advancing the assigned play piece of the current player on the play path by the number of movement spaces randomly determined, if the answer is correct;

retreating the assigned play piece on the play path by the number of movement spaces randomly determined, if the answer is incorrect;

distributing a PASS card to at least one opposing player when a player passes a turn, whereby a PASS card is optionally redeemable by a passing player possessing a PASS card; and issuing a BLOCK card to one of the players yielding a preselected number of accumulated PASS cards.

21. A method for playing a game for teaching vocabulary competitively playable between two or more players having comparable or varying vocabulary skill levels, said method comprising the steps of:

furnishing a game board with a play surface including a start point space, an end point space and a plurality of movement spaces arranged linearly to form a sequentially predetermined play path where select ones of said plurality of movement spaces include a first indicia for indicating a play command to a player;

assigning one of a plurality of play pieces to each player for placement on the start point space on the game board;

assigning a vocabulary skill level to each player;

furnishing at least one vocabulary skill level keyed deck of game cards, each of said game cards including on one side at least one vocabulary clue and a corresponding answer on an opposing side, each select one of said vocabulary clue or clues of a select game card of said deck of game cards, respectively, corresponding to a difficulty level matching a vocabulary skill level assigned to one or more players, respectively;

selecting a player for a turn as a current player;

drawing by chance a game card from the deck of game cards, the drawing being made by the current player;

indicating to the current player the vocabulary clue on said drawn game card corresponding to a difficulty level which matches the vocabulary skill level assigned to the current player;

determining randomly a number of movement spaces the player advances or retreats the assigned play piece on the play path;

receiving the answer to the vocabulary clue from the current player;

advancing the assigned play piece of the current player on the play path by the number of movement spaces randomly determined, if the answer is correct;

retreating the assigned play piece on the play path by the number of movement spaces randomly determined, if the answer is incorrect;

allowing the current player to pass the turn; and affording one of the opposing players of a lower or equal skill level an opportunity to furnish the answer to the vocabulary clue of the drawn game card as a bonus turn.

22. A method for playing a game for teaching vocabulary competitively playable between two or more players having comparable or varying vocabulary skill levels, said method comprising the steps of:

furnishing a game board with a play surface including a start point space, an end point space and a plurality of movement spaces arranged linearly to form a sequentially predetermined play path where select ones of said plurality of movement spaces include a first indicia for indicating a play command to a player;

assigning one of a plurality of play pieces to each player for placement on the start point space on the game board;

assigning a vocabulary skill level to each player;

furnishing at least one vocabulary skill level keyed deck of game cards, each of said game cards including on one side at least one vocabulary clue and a corresponding answer on an opposing side, each select one of said vocabulary clue or clues of a select game card of said deck of game cards, respectively, corresponding to a difficulty level matching a vocabulary skill level assigned to one or more players, respectively;

selecting a player for a turn as a current player;

drawing by chance a game card from the deck of game cards, the drawing being made by the current player;

indicating to the current player the vocabulary clue on said drawn game card corresponding to a difficulty level which matches the vocabulary skill level assigned to the current player;

determining randomly a number of movement spaces the player advances or retreats the assigned play piece on the play path;

receiving the answer to the vocabulary clue from the current player;

advancing the assigned play piece of the current player on-the play path by the number of movement spaces randomly determined, if the answer is correct;

retreating the assigned play piece on the play path by the number of movement spaces randomly determined, if the answer is incorrect;

distributing a PASS card to at least one opposing player when a player passes a turn, whereby a PASS card is optionally redeemable by a passing player possessing a PASS card; and seizing a PASS card from the current player, if the current player passes twice consecutively.

* * * * *